US007445085B2

(12) United States Patent
Petzl et al.

(10) Patent No.: US 7,445,085 B2
(45) Date of Patent: Nov. 4, 2008

(54) ROPING AND SUSPENSION HARNESS WITH ENHANCED RESISTANCE

(75) Inventors: Paul Petzl, Barraux (FR); Anne Bauvois, Hurtieres (FR)

(73) Assignee: Zedel, Crolles (FR)

( * ) Notice: Subject to any disclaimer, the term of this patent is extended or adjusted under 35 U.S.C. 154(b) by 354 days.

(21) Appl. No.: 10/926,138

(22) Filed: Aug. 26, 2004

(65) Prior Publication Data

US 2005/0072530 A1 Apr. 7, 2005

(30) Foreign Application Priority Data

Sep. 19, 2003 (FR) ..... 03 11014

(51) Int. Cl.
*A62B 1/16* (2006.01)

(52) U.S. Cl. ..... 182/6; 182/3; 182/7; 244/151 R; 2/310; 2/311; 2/338

(58) Field of Classification Search ..... 182/3, 182/6, 7, 36; 244/151 R; 119/907, 712, 119/857, 770; 2/1, 310, 311, 338
See application file for complete search history.

(56) References Cited

U.S. PATENT DOCUMENTS 1,967,767 A * 7/1934 Diez ..... 182/3
3,424,134 A * 1/1969 Rosenblum ..... 182/3
4,745,911 A * 5/1988 Bender ..... 482/139
5,188,585 A * 2/1993 Peters ..... 602/19
5,615,750 A * 4/1997 Phillips ..... 182/6
5,806,087 A * 9/1998 Grotefend ..... 2/1
6,050,364 A * 4/2000 Popall et al. ..... 182/6
6,189,651 B1 2/2001 Sadeck
6,941,585 B2 * 9/2005 Wells, Jr. ..... 2/338

FOREIGN PATENT DOCUMENTS

| | | |
|---|---|---|
| EP | 0 477 110 A1 | 3/1992 |
| FR | 2 750 609 | 1/1998 |
| WO | WO 02/28482 A1 | 4/2002 |

* cited by examiner

*Primary Examiner*—Katherine W Mitchell
*Assistant Examiner*—Colleen M Quinn
(74) *Attorney, Agent, or Firm*—Oliff & Berridge, PLC

(57) ABSTRACT

A roping and suspension harness is manufactured from a cushioned fabric the opposite lateral edges whereof at the level of the belt and leg loops are reinforced by support biases providing mechanical strength. The biases pass through the closing and/or adjustment device and return in the opposite direction to then be secured by fixing stitches.

7 Claims, 6 Drawing Sheets

ROPING AND SUSPENSION HARNESS WITH ENHANCED RESISTANCE

BACKGROUND OF THE INVENTION

The invention relates to a roping and suspension harness comprising a cushioned fabric the opposite lateral edges whereof are reinforced by support biases providing mechanical strength, and a closing and/or adjustment device for adapting to the user's morphology.

1. State of the Art

The documents FR 2,796,296 and WO 02/28482 describe harnesses wherein strengthening biases cover the edges of a cushioned fabric to provide the mechanical strength of the belt and leg loops. The adjustment loops are fixed by auxiliary straps, which require additional stitching and limit the mechanical strength of the assembly.

2. Object of the Invention

The object of the invention is to achieve a roping and suspension harness with enhanced mechanical strength, while simplifying the assembly mode and providing optimum comfort for the user.

The device according to the invention is characterized in that the biases pass through the closing and/or adjustment device and return in the opposite direction to then be secured by fixing means. Passage of the biases in the closing and/or adjustment device avoids the use of an auxiliary attachment strap, and increases the mechanical strength.

According to a preferred embodiment, the belt of the harness comprises a middle part of different width from that of the cushioned fabric and designed to form the attachment hasp whereto the closing device is secured by means of extensions of the biases. The hasp in addition comprises an internal webbing the edges whereof are covered by extensions of the biases acting at this location as a reinforcement against abrasion.

The harness can be formed by a sit harness, a body harness, a full harness, or even a securing belt. The closing and/or adjustment device is arranged in the form of a loop, or any other securing system.

Other features can be used either alone of in combination:

- the adjustment strap of the closing loop is sandwiched by a reinforcement part so as to transfer the mechanical forces of the biases to the adjustment strap;
- each leg loop is joined to the intermediate part of the sit harness by an extensible distributor joining part;
- each leg loop comprises an adjustment loop wherethrough the biases pass;
- each distributor joining part is formed by an extensible fabric in the form of a delta bordered by a flexible bias.

BRIEF DESCRIPTION OF THE DRAWINGS

Other advantages and features of the invention will become more clearly apparent from the following description of an embodiment of the invention given as a non-restrictive example only and represented in the accompanying drawings, in which.

DESCRIPTION OF A PREFERRED EMBODIMENT

Figure 1:
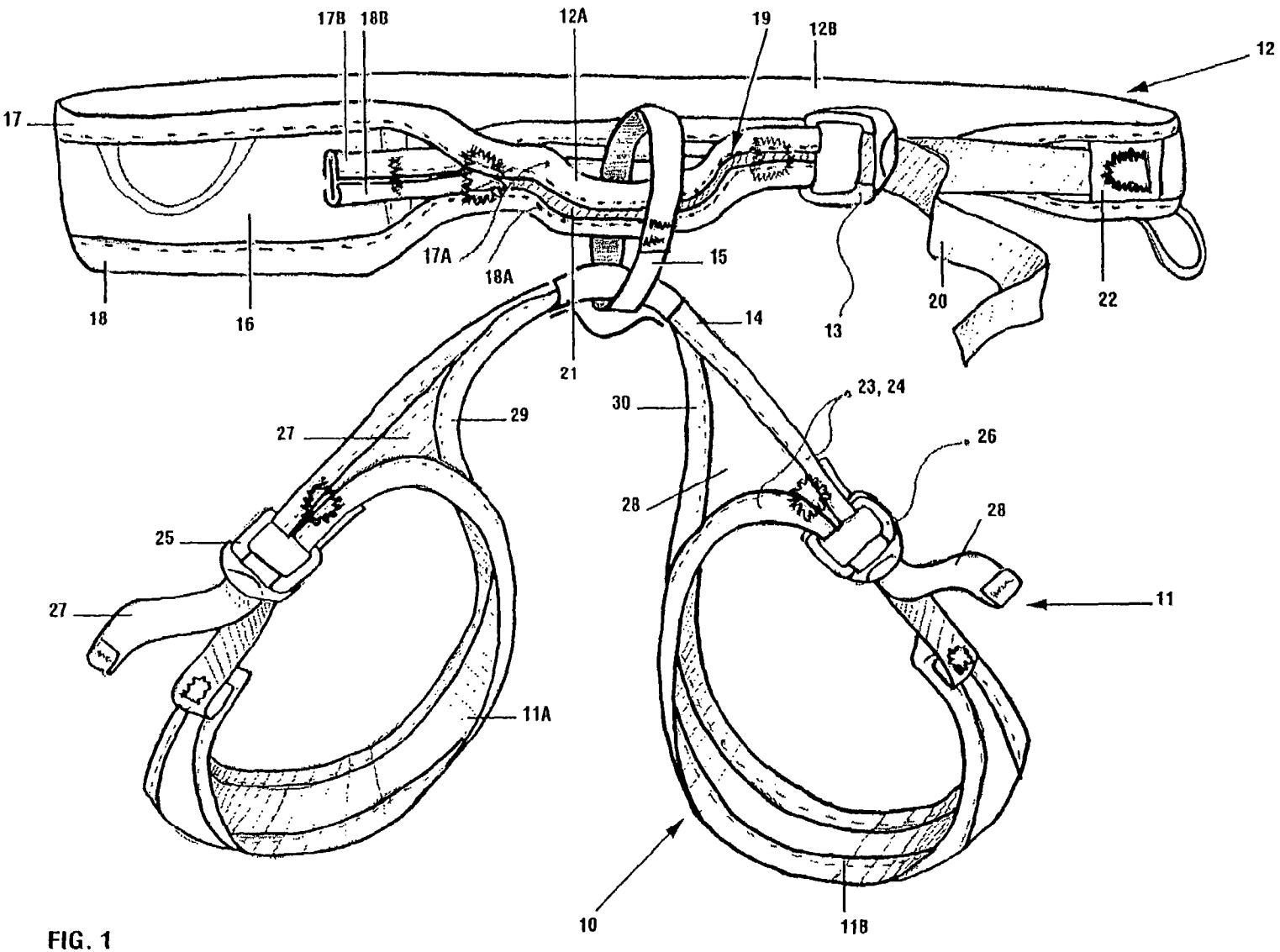
FIG. 1 is a perspective view of a harness according to the invention, the harness being formed by a sit harness with a hooking ring.

With reference to FIG. 1, a roping and/or suspension harness 10 comprises a sit harness 11 having a pair of leg loops 11A, 11B, and an adjustable belt equipped with a loop of a closing device 13. The two leg loops 11A, 11B are joined to one another by a flexible intermediate part 14 in the shape of an inverted V.

A hooking ring 15 acts at the same time as connecting means of the sit harness 11 to the belt 12 and as attachment means for a connector or a belaying rope. The ring 15 is preferably formed by an annular webbing surrounding with clearance the ventral middle part 12A of the belt 12 and the intermediate part 14 of the sit harness 11.

The belt comprises a cushioned fabric 16, for example made from a synthetic material stuffed with padding foam, the lateral edges whereof are strengthened by a pair of biases 17, 18.

The biases 17, 18 are sewn overlapping and without discontinuity over the whole length of the opposite edges of the cushioned fabric 16 and form the support elements giving the belt mechanical strength.

The ventral middle part 12A of the belt 12 presents a different width, notably smaller than that of the cushioned fabric 16, and the biases 17, 18 are extended in this part passing through the loop 13 to return in the opposite direction on the inside so as to form the central hasp 19. The loop 13 is thus securedly attached to the hasp 19 and is designed to secure an adjustment strap 20 fixed to the other end of the dorsal part 12B of the belt 12. The biases 17, 18 running through the loop 13 avoid the use of an auxiliary attachment strap opposite the adjustment strap 20.

The loop of the closing device 13 enables the circumference of the belt 12 to be adjusted to the size of the user's waist. The loop 13 is of the type described in the document EP 614,626, but any other fastener or securing system can be used.

The structure of the hasp 19 comprises an inside webbing 21 of great mechanical strength, covered by extensions 17A, 18A of the biases 17, 18 forming strengthening means to resist abrasion. After passing through the loop 13, the ends 17B, 18B of the biases 17, 18 return in the opposite direction on the inside and pass back onto the outside face via a hole to then be fixed by sewing.

The adjustment strap 20 is sandwiched by a sewn reinforcement part 22 so as to transfer the mechanical forces of the biases 17, 18 to the adjustment strap 20 to ensure the solidity of the assembly.

The sit harness 11 is of the padded type described in the Patent FR 2,796,296, but is shaped as for the belt, with biases 23, 24 passing through a loop of the adjustment device 25, 26 of each leg loop 11A, 11B. Each adjustment loop 25, 26 is designed to jam an adjustment strap 27, 28 fixed by stitches to the other end of the leg loop 11A, 11B.

The delta-shaped distributor joining part 27, 28 is advantageously formed by an extensible fabric bordered by a bias or a flexible hem 29, 30. The presence of this pair of extensible links enables the user to benefit from a complementary adjustment range, and the passage of the biases 23, 24 in the adjustment loops 25, 26 avoids superposition of an auxiliary strap. The user's comfort is thus improved, as is the mechanical strength of the sit harness 11.

Figure 2:
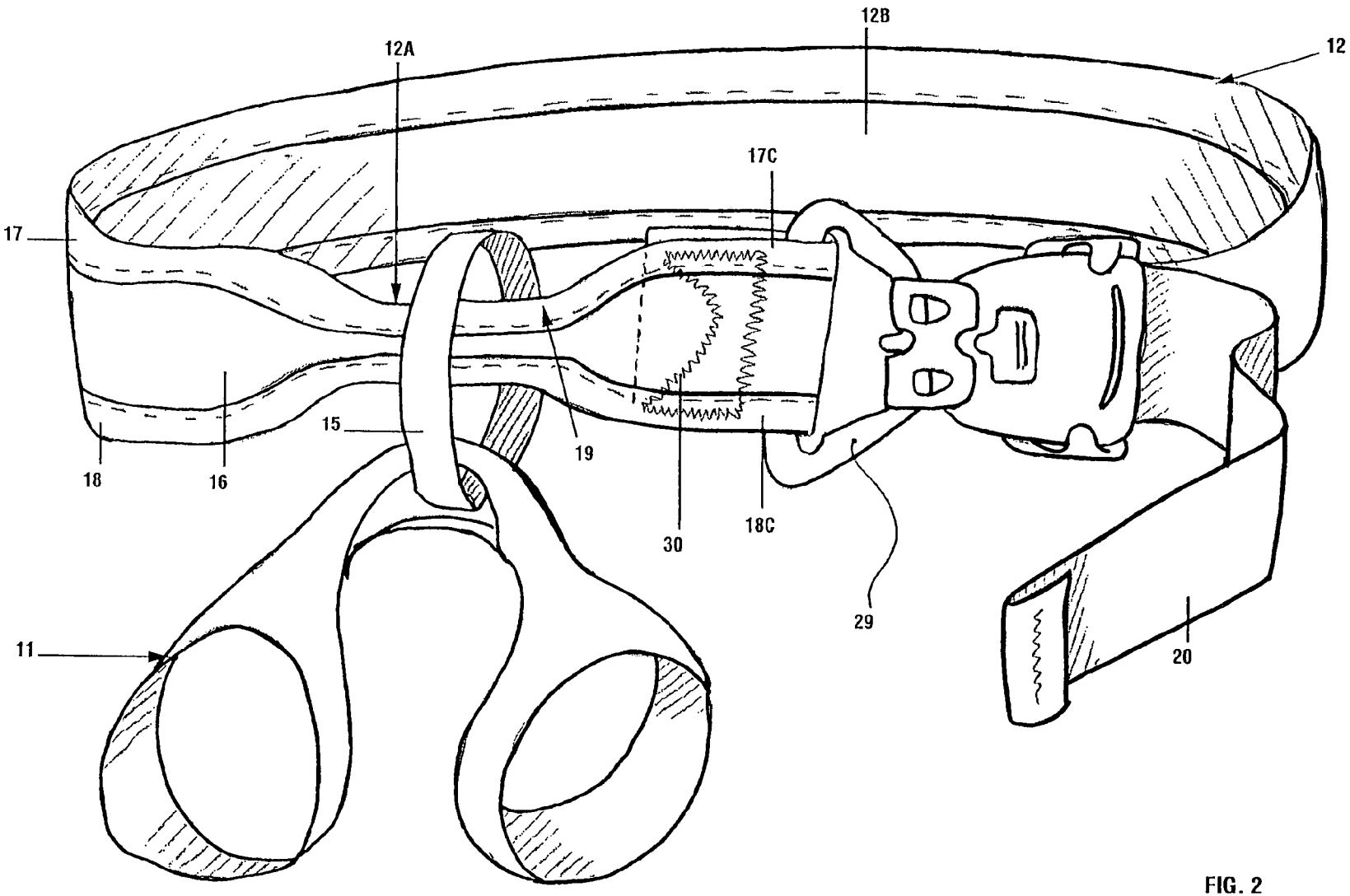
FIGS. 2 and 3 are alternative embodiments of the sit harness of FIG. 1.

In the alternative embodiment of FIG. 2, the same reference numbers designate identical or similar parts to those of FIG. 1. Tapering of the biases 17, 18 of the belt 12 takes place at the level of the hasp 19, which has a smaller width than the rest of the belt. The closing loop 29 is wider and is of the clip-fast or clasp type. The extensions 17C, 18C of the biases pass through the loop 29, then return via the inside being directly fixed by stitches 30 or any other fixing means.

Figure 3:
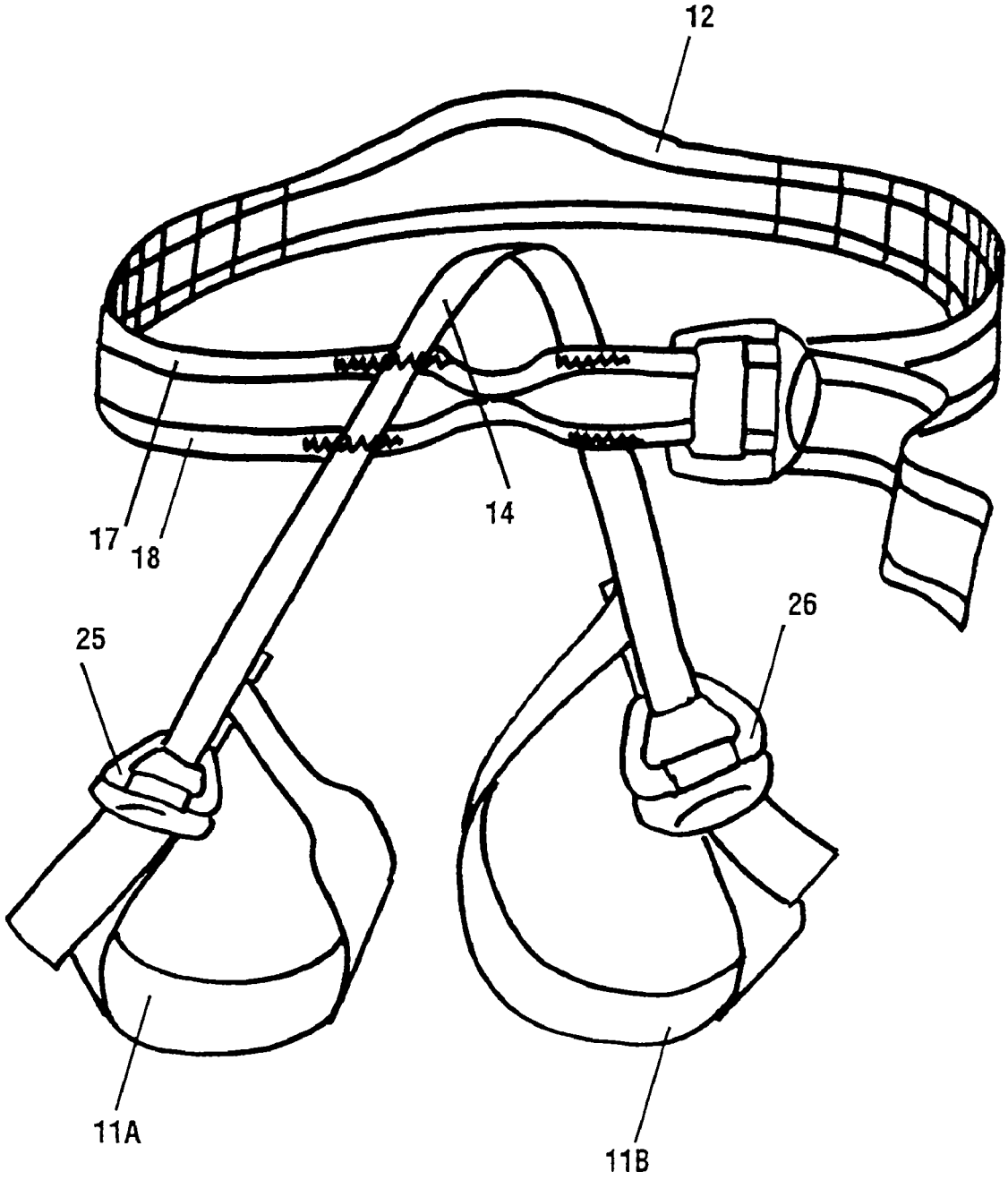

FIG. 3 shows another alternative embodiment of the sit harness of collective type wherein the intermediate part 14 of the leg loops 11A, 11B forms the hooking ring which is securedly attached to the leg loops and is directly joined to the biases 17, 18 of the belt 12 by stitching or any other fixing means.

Figure 4:
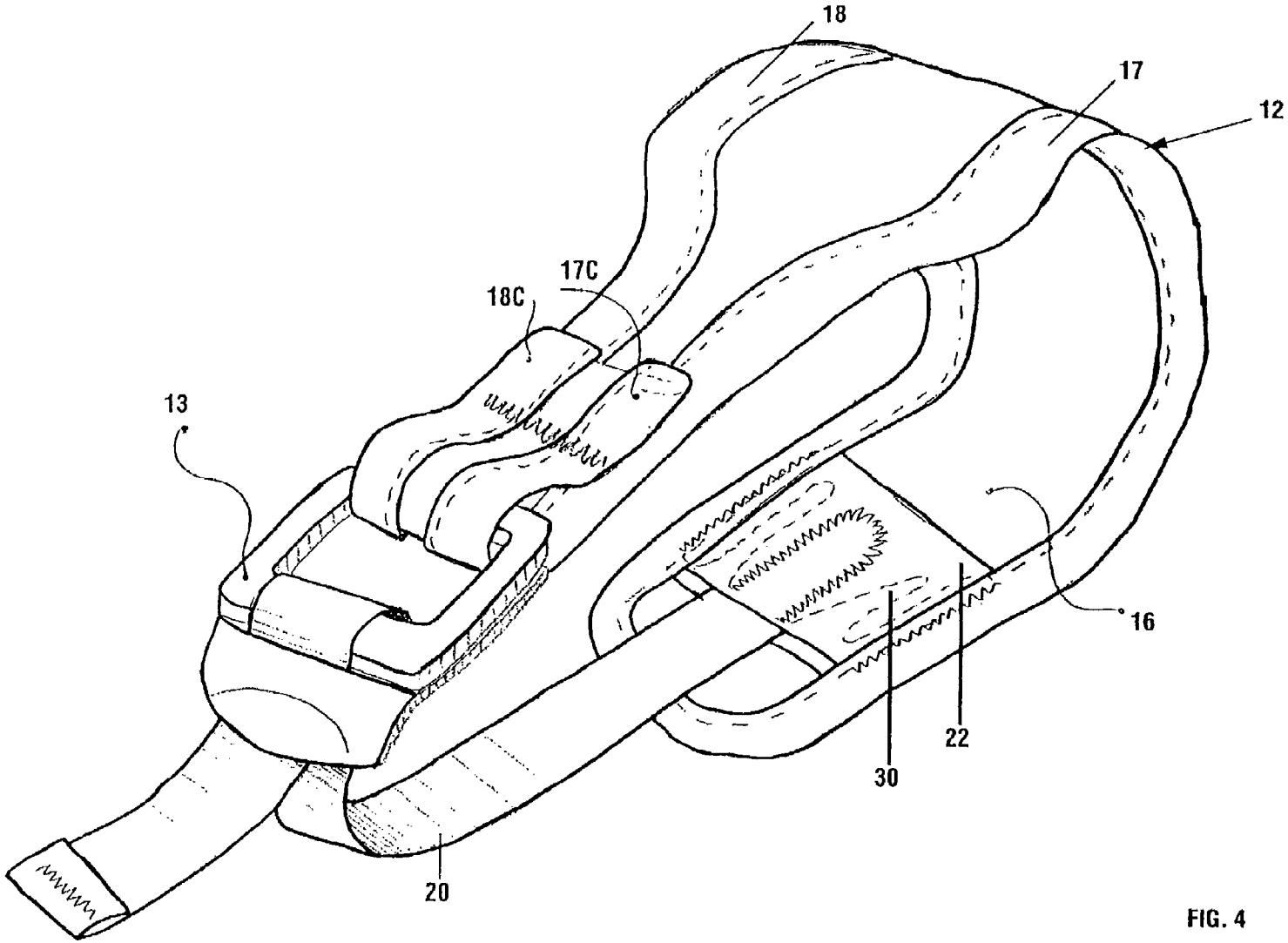
FIG. 4 shows another alternative embodiment wherein the harness is in the form of a securing belt.

FIG. 4 illustrates a securing belt 12 shaped as in FIG. 1, with biases 17,18 passing through the closing loop 13, with extensions 17C, 18C sewn onto the outside face of the fabric 16.

Figure 5:
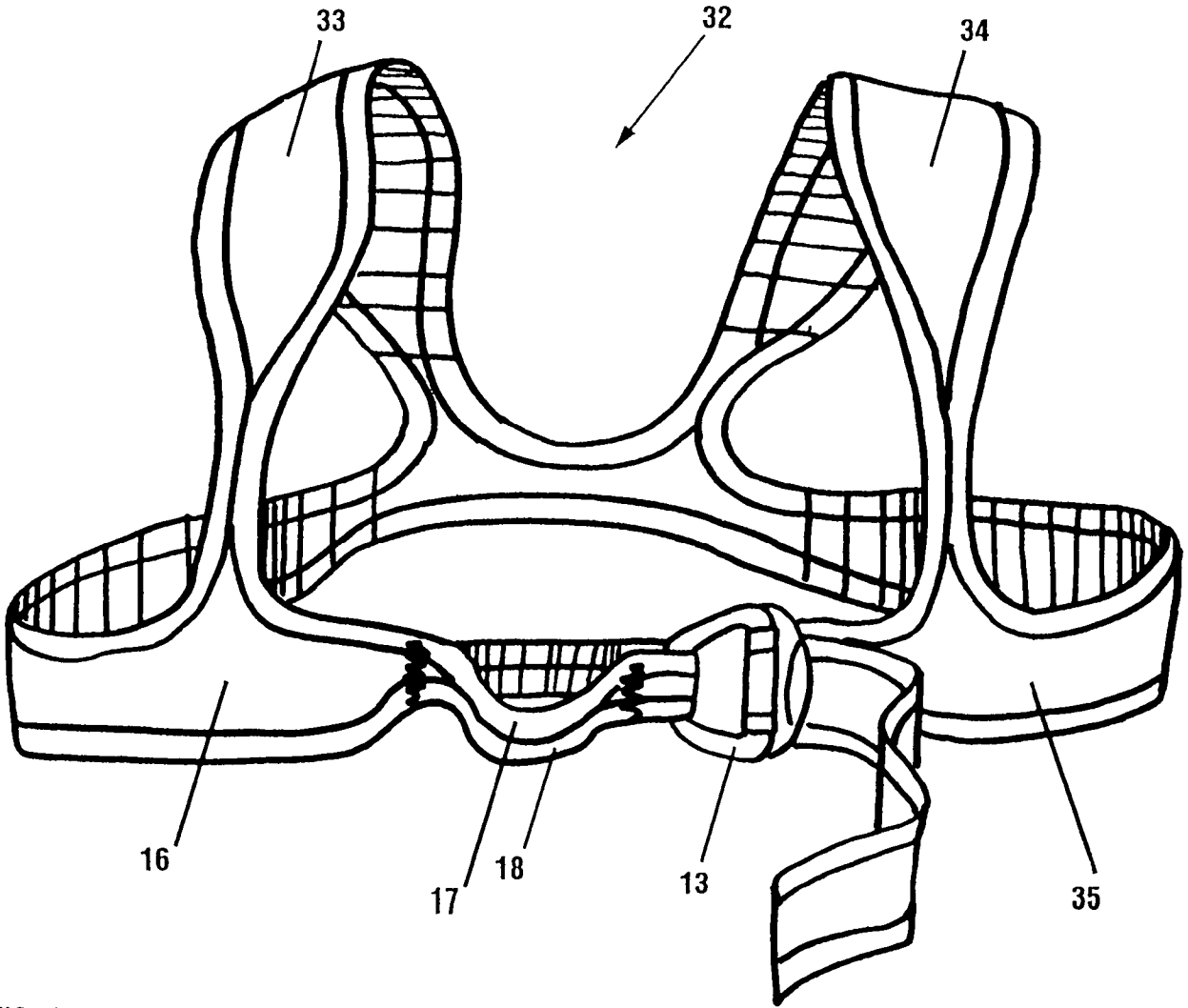
FIGS. 5 and 6 represent two other alternative embodiments respectively of a body harness and a full harness using the same principle of the biases passing through the closing device.

FIG. 5 represents a body harness 32 composed of two shoulder straps 33, 34 joined to a chest strap 35. The same padded fabric 16 is used with the biases 17, 18 passing through the loop 13 of the strap 35.

Figure 6:
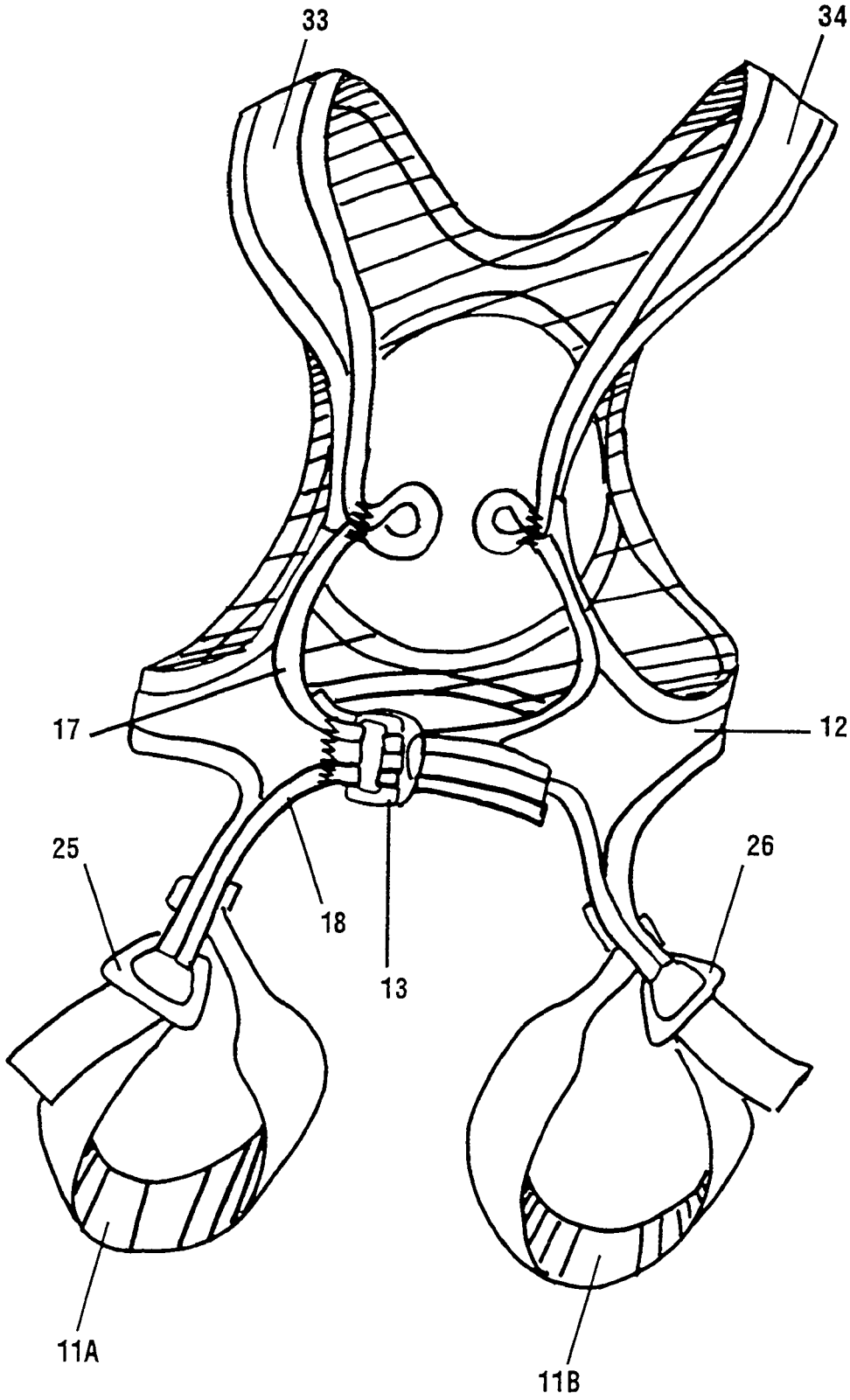

FIG. 6 illustrates a full harness 36 composed of a sit harness and a body harness, the biases 17, 18 whereof pass through the closing loop 13 of the belt 12 and the adjustment loops 25, 26 of the leg loops 11A, 11B.

The structure of the hasp 19 described in FIG. 1 can also be used to achieve chest (FIG. 5) and dorsal roping points (not shown).

The invention claimed is:

1. A roping and suspension harness comprising:

a sit harness having an intermediate part, a belt, and a hooking ring for connecting the sit harness to the belt and for attaching the belt to a rope, the belt further comprising:

a cushioned fabric having an outer surface, an inner surface, and opposite upper and lower edges;

support biases sewn overlapping without discontinuity, respectively along the upper and lower edges of the cushioned fabric to reinforce a mechanical strength of the fabric; and a closing and adjustment buckle;

a ventral middle part of the belt having a different width from that of the cushioned fabric, wherein the biases extend beyond the end of the cushioned fabric forming the narrower ventral middle part for passing through the closing and adjustment buckle and returning in the opposite direction so as to form a central hasp;

wherein the hooking ring is positioned with clearance through both the ventral middle part of the belt and the intermediate part of the harness, and wherein the portion in the biases that extend beyond the end of the cushioned fabric pass through the closing and adjustment buckle, return in the opposite direction along the inner surface of the belt, and return to the outer surface of the belt through an opening formed between the end of the cushioned fabric and the support biases extensions and are then fixed to the outer surface of the cushioned fabric.

2. The roping and suspension harness according to claim 1, the central hasp further comprising an inside webbing for reinforcing and protecting the hasp, the inside webbing being covered by extensions of the biases.

3. The roping and suspension harness according to claim 1, wherein the closing and adjustment buckle cooperates with an adjustment strap fixed to an other end of the inside face of said fabric.

4. The roping and suspension harness according to claim 3, wherein the adjustment strap is sandwiched by a reinforcement part fixed in a way to transfer mechanical forces of the biases to the adjustment strap.

5. The roping and suspension harness according to claim 1, wherein the sit harness further comprises a first extensible distributor joining part and a second extensible distributor joining part and a first leg loop and a second leg loop, the first leg loop and the second leg loop having an upper edge, a lower edge and biases sewn respectively along the upper and lower edges of the first and second leg loops, wherein the first leg loop and the second leg loop are joined to the intermediate part of the sit harness on opposite ends respectively by the first extensible distributor joining part and the second extensible distributor joining part.

6. The roping and suspension harness according to claim 5, wherein each leg loop is provided with an adjustment means through which the leg loop biases pass.

7. The roping and suspension harness according to claim 5, wherein the extensible distributor joining part is formed by an extensible fabric, having an upper edge and a lower edge, the upper and lower edges of the extensible fabric bordered by the bias or a flexible hem.

* * * * *